US009811017B2

(12) United States Patent
Wolfe et al.

(10) Patent No.: US 9,811,017 B2
(45) Date of Patent: Nov. 7, 2017

(54) HYPERPIGMENTED LOW MELT TONER

(71) Applicant: XEROX CORPORATION, Norwalk, CT (US)

(72) Inventors: Christopher M. Wolfe, Rochester, NY (US); Padam K. Angra, Pittsford, NY (US); Jacob W. Myers, II, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/055,370

(22) Filed: Feb. 26, 2016

(65) Prior Publication Data

US 2017/0248858 A1 Aug. 31, 2017

(51) Int. Cl.
*G03G 9/093* (2006.01)
*G03G 9/08* (2006.01)

(52) U.S. Cl.
CPC ..... *G03G 9/09378* (2013.01); *G03G 9/0821* (2013.01); *G03G 9/09321* (2013.01); *G03G 9/09335* (2013.01); *G03G 9/09364* (2013.01); *G03G 9/09371* (2013.01)

(58) Field of Classification Search
CPC ..... G03G 9/08711; G03G 9/09364; G03G 9/09371; G03G 9/09321; G03G 9/09335; G03G 9/09378
USPC ..... 430/109.3, 110.2
See application file for complete search history.

(56) References Cited

U.S. PATENT DOCUMENTS

| | | | | |
|---|---|---|---|---|
| 5,227,460 | A | 7/1993 | Mahabadi et al. | |
| 6,004,714 | A | 12/1999 | Ciccarelli et al. | |
| 9,122,179 | B2 | 9/2015 | Schneider et al. | |
| 2004/0137352 | A1 | 7/2004 | McStravick et al. | |
| 2007/0248902 | A1* | 10/2007 | Asarese | G03G 9/0806 430/108.4 |
| 2015/0268573 | A1* | 9/2015 | Iwazaki | G03G 9/0806 430/105 |
| 2017/0023873 | A1* | 1/2017 | Fujisaki | G03G 9/08726 |

FOREIGN PATENT DOCUMENTS

JP 2017-26916 A * 2/2017

OTHER PUBLICATIONS

ESPACENET machine-assisted English-language translation of Japanese Patent 2017-026916 A (pub 02-2107).*

* cited by examiner

*Primary Examiner* — Janis L Dote
(74) *Attorney, Agent, or Firm* — Pillsbury Winthrop Shaw Pittman LLP

(57) ABSTRACT

A low melt toner includes a core having a core polystyrene-butyl acrylate resin, a crystalline polyester resin, a pigment present in an amount from about 7% to about 20% by weight of the low melt toner, and a paraffin wax; a ratio of the polystyrene-butyl acrylate resin to crystalline polyester resin is in a range from about 5:1 to about 7:1; and a shell disposed over the core including a shell polystyrene-butyl acrylate resin.

14 Claims, 5 Drawing Sheets

HYPERPIGMENTED LOW MELT TONER

BACKGROUND

The present disclosure relates to toner particles. In particular, embodiments herein relate to hyperpigmented low melt toner particles.

Under printing conditions with short dwell times the performance of toner particles having nominal pigment loadings (and even typical hyperpigmented loadings) may exhibit marginal crease performance. There is a need to address this issue with new material solutions. The present disclosure provides material solutions that address these and related issues.

SUMMARY

In some aspects, embodiments herein relate to low melt toners comprising a core comprising a core polystyrene-butyl acrylate resin, a crystalline polyester resin, a pigment present in an amount from about 7% to about 20% by weight of the low melt toner, and a paraffin wax, wherein a ratio of the polystyrene-butyl acrylate resin to crystalline polyester resin is in a range from about 5:1 to about 7:1, and the low melt toners further comprising a shell disposed over the core comprising a shell polystyrene-butyl acrylate resin.

In some aspects, embodiments herein relate to low melt toners comprising a core comprising a core polystyrene-butyl acrylate resin, a crystalline polyester resin, a pigment present in a range in an amount from about 7% to about 20% by weight of the low melt toner, a Fischer-Tropsch wax, and a paraffin wax, wherein a ratio of the polystyrene-butyl acrylate resin to crystalline polyester resin is in a range from about 5:1 to about 7:1, and a shell disposed over the core comprising a shell polystyrene-butyl acrylate resin.

In some aspects, embodiments herein relate to low melt toners comprising a core comprising, a core polystyrene-butyl acrylate resin present in an amount in a range from about 35% to about 45% by weight of the low melt toner, a crystalline polyester resin present in an amount in a range from about 5% to about 8% by weight of the low melt toner, a pigment present in an amount in a range from about 7% to about 20% by weight of the low melt toner, a Fischer-Tropsch wax present in an amount in a range from about 8% to about 10% by weight of the low melt toner, and a paraffin wax present in an amount in a range from about 1% to about 3% by weight of the low melt toner, and a shell disposed over the core comprising a shell polystyrene-butyl acrylate resin, wherein the shell polystyrene-butyl acrylate resin is present in an amount in a range from about 30% to about 35% by weight of the low melt toner.

BRIEF DESCRIPTION OF DRAWINGS

Various embodiments of the present disclosure will be described herein below with reference to the figures wherein.

DETAILED DESCRIPTION

Figure 1:
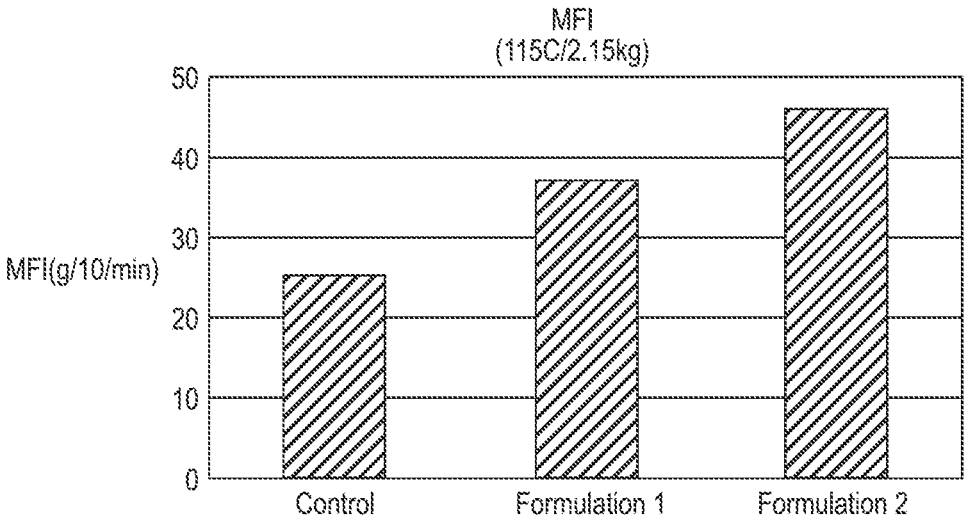
FIG. 1 shows a bar graph of melt flow indices for exemplary low melt toners in accordance with embodiments herein.

Embodiments herein provide hyper-pigmented low melt toner compositions comprising crystalline polyester material in the core of the particle and about one and half times the normal pigment loading compared to nominal mono toner. The low melt toners disclosed herein provide lower minimum fix temperatures to impart acceptable crease fix latitude in so-called C speed printing engines. These machines have the highest speed engines (about 80 pages per minute and such machines represent the highest process/fusing speed) and lower toner mass per unit area (TMA, a measurement on how much toner is on the page) to allow lower toner consumption and thereby reduce run cost.

As used herein, "fix temperature" refers to temperature at which toner is adhered to its target substrate, typically some kind of paper.

As used herein "crease fix latitude" refers to a range of acceptable fix temperatures that provide good performance in a crease fix test. The performance is measured by folding printed images that have been fused over a wide range of fusing temperatures and then rolling a defined mass across the folded area. The print can also be folded using a commercially available folder such as the Duplo D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease minimum fix temperature (MFT).

Embodiments herein provide low melt toners comprising a core comprising a core polystyrene-butyl acrylate resin, a crystalline polyester resin, a pigment present in an amount from about 7% to about 20% by weight of the low melt toner, and a paraffin wax, wherein a ratio of the polystyrene-butyl acrylate resin to crystalline polyester resin is in a range from about 5:1 to about 7:1, the low melt toner further comprising a shell comprising a shell polystyrene-butyl acrylate resin.

As used herein "low melt toner" refers to an improved fusing toner characterized by faster fusing with a better melt. The low melt toners disclosed herein are designed to operate under rapid print conditions with short dwell times. With a lower fusing temperature (or an earlier melt) less strain is placed on the fuser allowing more pages per minute to be fused. Less energy to melt the toner translates to faster print speeds.

In embodiments, the core polystyrene-butyl acrylate resin may be present in an amount from about 30% to about 50% by weight of the low melt toner, or about 38% to about 48%, or about 40% to about 42%.

In embodiments, the crystalline polyester resin is present in an amount from about 5% to about 10% by weight of the low melt toner, or about 6% to about 9%, or about 7.5% to about 8.5%.

In embodiments, the paraffin wax is present in a range from about 1% to about 10% by weight of the low melt toner, or about 1% to about 5%, or about 1% to about 2%.

In embodiments, the low melt toner further comprises a second wax different from the paraffin wax. In embodiments, the second wax is a Fischer-Tropsch wax. In some such embodiments, the Fischer-Tropsch wax may be present in a range from about 5% to about 8% by weight of the low melt toner.

In embodiments, the core polystyrene-butyl acrylate and the shell polystyrene-butyl acrylate may be the same.

In embodiments, the shell polystyrene-butyl acrylate is present in a range from about 25% to about 36% by weight of the low melt toner, or about 28% to about 36%, or about 32% to about 36%.

In embodiments, the pigment is present in a range from about 8% to about 11% by weight of the low melt toner, or about 8% to about 10%, or about 8.5% to about 9.5%.

In embodiments, there are provided low melt toners comprising a core comprising a core polystyrene-butyl acrylate resin, a crystalline polyester resin, a pigment present in a range in an amount from about 7% to about 20% by weight of the low melt toner, a Fischer-Tropsch wax, and a paraffin wax, wherein a ratio of the polystyrene-butyl acrylate resin to crystalline polyester resin is in a range from about 5:1 to about 7:1, and the low melt toner further comprises a shell comprising a shell polystyrene-butyl acrylate resin. In embodiments, the Fischer-Tropsch wax is present in an amount in a range from about 5% to about 8% by weight of the low melt toner.

In embodiments, the paraffin wax is present in a range from about 1% to about 3% by weight of the low melt toner. In embodiments, the pigment is present from about 8% to about 10% by weight of the low melt toner.

Any monomer suitable for preparing a latex for use in a toner may be utilized in preparing the core. In embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like. In particular embodiments, the core comprises a polystyrene-butyl acrylate resin.

Exemplary polymers include styrene acrylates, styrene butadienes, styrene methacrylates, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkylmethacrylate-acrylic acid), poly(alkyl methacrylate-alkyl acrylate), poly (alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propylmethacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene), poly (styrene-propyl acrylate), poly(styrene-butyl acrylate), poly (styrene-butadiene-acrylic acid), poly(styrene-butadiene-methacrylic acid), poly(styrene-butadiene-acrylonitrile-acrylic acid), poly(styrene-butyl acrylate acrylic acid), poly (styrene-butyl acrylate-methacrylic acid), poly(styrene-butyl acrylate-acrylononitrile), poly(styrene-butyl acrylate-acrylonitrile-acrylic acid), poly(styrene-butadiene), poly (styrene-isoprene), poly(styrene-butyl methacrylate), poly (styrene-butyl acrylate-acrylic acid), poly(styrene-butyl methacrylate-acrylic acid), poly(butyl methacrylate-butyl acrylate), poly(butyl methacrylate-acrylic acid), polyacrylonitrile-butyl acrylate-acrylic acid), and combinations thereof. The polymers may be block, random, or alternating copolymers.

In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex resin. The glass transition temperature of this latex, which in embodiments may be used to form a toner of the present disclosure, may be from about 35° C. to about 75° C., in embodiments from about 40° C. to about 70° C.

The crystalline polyester resin useful in the low melt toners may be formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, such as from about 42 to about 55 mole percent, or from about 45 to about 53 mole percent (although amounts outside of these ranges can be used), and the alkali sulfo-aliphatic diol can be selected in an amount of from about 0 to about 10 mole percent, such as from about 1 to about 4 mole percent of the resin (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, from about 40 to about 60 mole percent, in embodiments from about 42 to about 52 mole percent, such as from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Examples of crystalline resins that may be used in lieu of crystalline polyesters include, without limitation, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly (butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly (5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

In embodiments, the pigment of the low melt toners may be carbon black. More generally, the low melt toner particles described herein can include any colorant. Colorants include pigments, dyes, mixtures of dyes, mixtures of pigments, mixtures of dyes and pigments, and the like made in accordance with the methods disclosed herein. Suitable colorants include those comprising carbon black, such as, REGAL 330® and NIPEX 35. Colored pigments, such as, cyan, magenta, yellow, red, orange, green, brown, blue or mixtures thereof can be used. The additional pigment or pigments can be used as water based pigment dispersions. Suitable colorants include inorganic pigments and organic pigments. Examples of pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE, PYLAM OIL YELLOW and PIGMENT BLUE I™ available from Paul Uhlich & Company, Inc.; PIGMENT VIOLET I, PIGMENT RED48™, LEMON CHROME YELLOW DCC IO26™, TOLUIDINE RED and BON RED C available from Dominion Color Corporation, Ltd., Toronto, Ontario; NOVAPERM YELLOW FGL and HOSTAPERM PINK E from Hoechst; CINQUASIA MAGENTA available from E.I. DuPont de Nemours & Co., and the like. Examples of magenta pigments include 2,9-dimethyl-substituted quinacridone, an anthraquinone dye identified in the Color Index as CI 60710, CI Dispersed Red 15, a diazo dye identified in the Color Index as CI 26050, CI Solvent Red 19 and the like. Illustrative examples of cyan pigments include copper tetra(octadecylsulfonamido) phthalocyanine, a copper phthalocyanine pigment listed in the Color Index as CI 74160, CI Pigment Blue, Pigment Blue 15:3, Pigment Blue 15:4, an Anthrazine Blue identified in the Color Index as CI 69810, Special Blue X-2137 and the like. Illustrative examples of yellow pigments are diarylide yellow 3,3 dichlorobenzidene acetoacetanilide, a monoazo pigment identified in the Color Index as CI 12700, CI Solvent Yellow 16, a nitrophenyl amine sulfonamide identified in the Color Index as Foron Yellow SE/GLN, CI Disperse Yellow 3, 2,5 dimethoxy-4-sulfonanilide phenylazo-4'-chloro-2,5-dimethoxy acetoacetanilide and Permanent Yellow FGL.

Examples of inorganic pigments include such as, Ultramarine violet: (PV15) Silicate of sodium and aluminum containing sulfur; Han Purple: $BaCuSi_2O_6$; Cobalt Violet: (PV14) cobalt phosphate; Manganese Violet: (PV16) Manganese ammonium phosphate; Ultramarine (PB29): a complex naturally occurring pigment of sulfur-containing sodiosilicate ($Na_{8-10}Al_6Si_6O_{24}S_{2-4}$); Cobalt Blue (PB28) and Cerulean Blue (PB35): cobalt(II) stannate; Egyptian Blue: a synthetic pigment of calcium copper silicate ($CaCuSi_4O_{10}$); Han Blue: $BaCuSi_4O_{10}$; Prussian Blue (PB27): a synthetic pigment of ferric hexacyanoferrate ($Fe_7(CN)_{18}$). The dye Marking blue is made by mixing Prussian Blue and alcohol; $YIn_{1-x}Mn_xO_3$: a synthetic pigment made from inserting Mn into the trigonal bipyramidal atomic site of the $YInO_3$ crystal structure. Cadmium Green: a light green pigment consisting of a mixture of Cadmium Yellow (CdS) and Viridian ($Cr_2O_3$); Chrome Green (PG17); Viridian (PG18): a dark green pigment of hydrated chromium(III) oxide ($Cr_2O_3$); Paris Green: copper(II) acetoarsenite; ($Cu(C_2H_3O_2)_2.3Cu(AsO_2)_2$); Scheele's Green (also called Schloss Green): copper arsenite $CuHAsO_3$; Orpiment natural monoclinic arsenic sulfide ($As_2S_3$); Cadmium Yellow (PY37): cadmium sulfide (CdS); Chrome Yellow (PY34): natural pigment of lead(II) chromate ($PbCrO_4$); Aureolin (also called Cobalt Yellow) (PY40): Potassium cobaltinitrite ($Na_3Co(NO_2)_6$; Yellow Ochre (PY43): a naturally occurring clay of hydrated iron oxide ($Fe_2O_3.H_2O$); Naples Yellow (PY41); Titanium Yellow (PY53); Mosaic gold: stannic sulfide ($SnS_2$); Cadmium Orange ($PO_{20}$): an intermediate between cadmium red and cadmium yellow: cadmium sulfoselenide; Chrome Orange: a naturally occurring pigment mixture composed of lead(II) chromate and lead(II) oxide. ($PbCrO_4$+PbO); Cadmium Red (PR108): cadmium selenide (CdSe); Sanguine, Caput Mortuum, Venetian Red, Oxide Red (PR102); Burnt Sienna (PBr7): a pigment produced by heating Raw Sienna; Carbon Black (PBk7); Ivory Black (PBk9); Vine Black (PBk8); Lamp Black (PBk6); Titanium Black; Antimony White: $Sb_2O_3$; Barium sulfate (PW5); Titanium White (PW6): titanium(IV) oxide $TiO_2$; Zinc White (PW4): Zinc Oxide (ZnO)

Other known colorants can be used, such as, Levanyl Black A SF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (CibaGeigy), Paliogen Red 3871K (BASF), Paliogen Red 3340 (BASF), Lithol Fast Scarlet L4300 (BASF), combinations of the foregoing and the like. Other pigments that can be used, and which are commercially available include various pigments in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

The colorant, for example carbon black, cyan, magenta and/or yellow colorant, may be incorporated in an amount sufficient to impart the desired color to the toner. In general, pigment or dye, may be employed in an amount ranging from about 7% to about 20% by weight of the low melt toner particles on a solids basis, from about 8% to about 10% by weight or any loading more than typical nominal loading which is usually less than about 6%.

In embodiments, more than one colorant may be present in a toner particle. For example, two colorants may be present in a toner particle, such as, a first colorant of pigment blue, may be present in an amount ranging from about 2% to about 10% by weight of the toner particle on a solids basis, from about 3% to about 8% by weight or from about 5% to about 10% by weight; with a second colorant of pigment yellow that may be present in an amount ranging from about 5% to about 20% by weight of the toner particle on a solids basis, from about 6% to about 15% by weight or from about 10% to about 20% by weight and so on.

In embodiments, there are provided low melt toners comprising a core comprising a core polystyrene-butyl acrylate resin present in an amount in a range from about 35% to about 45% by weight of the low melt toner, a crystalline polyester resin present in an amount in a range from about 5% to about 8% by weight of the low melt toner, a pigment present in an amount in a range from about 7% to about 20% by weight of the low melt toner, a Fischer-Tropsch wax present in an amount in a range from about 8% to about 10% by weight of the low melt toner, and a paraffin wax present in an amount in a range from about 1% to about 3% by weight of the low melt toner, the low melt toner further comprising a shell comprising a shell polystyrene-butyl acrylate resin, wherein the shell polystyrene-butyl acrylate resin is present in an amount in a range from about 30% to about 35% by weight of the low melt toner.

In embodiments, the pigment is present in an amount in a range from about 8% to about 10% by weight of the low melt toner.

In embodiments, the low melt toner has a $T_g$ onset less than about 54° C.

In embodiments, the shell further comprises a wax. In some such embodiments, the aforementioned quantities of wax may be divided between the shell and the core of the toner particles. In some embodiments, the wax is in the shell only. In some embodiments the wax is in the core only. In some embodiments the waxes are evenly distributed between the shell and the core. In embodiments with two waxes, each wax may independently appear in any distribution between the shell and the core.

Suitable waxes for the low melt toner particles include, but are not limited to, alkylene waxes such as alkylene wax having about 1 to about 25 carbon atoms, polyethylene, polypropylene or mixtures thereof. In embodiments, the waxes may be Fischer-Tropsch waxes, and paraffin waxes, or combinations thereof. The waxes may be present, for example, in an amount of about 6% to about 15% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes possess, it is believed, a molecular weight (Mw) of about 1,000 to about 5,000, and the commercially available polypropylenes are believed to possess a molecular weight of about 4,000 to about 10,000. Examples of functionalized waxes include amines, amides, for example Aqua SUPERSLIP6550™, SUPERSLIP6530™ available from Micro Powder Inc., fluorinated waxes, for example POLYFLUO190™, POLYFLUO 200™, POLYFLUO 523XF™, AQUA POLYFLUO 41™, AQUA POLYSILK 19™, POLYSILK14™ available from Micro Powder Inc., mixed fluorinated, amide waxes, for example Microspersion 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical and Petrolite Corporation and SC Johnson Wax, and Q436B available from Cytech, IGI, or Sasol.

In some embodiments, the wax comprises a wax in the form of a dispersion comprising, for example, a wax having a particle diameter of about 100 nanometers to about 500 nanometers, water, and an anionic surfactant. In embodiments, the wax is included in amounts such as about 6 to about 15 weight percent. In embodiments, the wax comprises polyethylene wax particles, such as Polywax 850, commercially available from Baker Petrolite, although not limited thereto, having a particle diameter in the range of about 100 to about 500 nanometers, although not limited. The surfactant used to disperse the wax is an anionic surfactant, although not limited thereto, such as, for example, NEOGEN RK™ commercially available from Kao Corporation or TAYCAPOWER BN2060 commercially available from Tayca Corporation.

In embodiments, other surface toner additives may be included. For example, the toner particles disclosed herein can include an externally applied additive which includes at least one of surface-treated silica, surface-treated titania, spacer particles, and combinations thereof. The additives may be packaged together as an additives package to add to the toner particles. That is, the toner particles are first formed, followed by mixing of the toner particles with the materials of the additives package. The result is that some components of the additive package may coat or adhere to external surfaces of the toner particles, rather than being incorporated into the bulk of the toner particles.

Any suitable untreated silica or surface treated silica can be used. Such silicas can be used alone, as only one silica, or can be used in combination, such as two or more silicas. Where two or more silicas are used in combination, it is may be beneficial, although not required, that one of the surface treated silicas be a decyl trimethoxysilane (DTMS) surface treated silica. In particular embodiments, the silica of the decyl trimethoxysilane (DTMS) surface treated silica may be a fumed silica.

Conventional surface treated silica materials are known and include, for example, TS-530 from Cabosil Corporation, with an 8 nanometer particle size and a surface treatment of hexamethyldisilazane; NAX50, obtained from Evonik Industries/Nippon Aerosil Corporation, coated with HMDS; H2050EP, obtained from Wacker Chemie, coated with an amino functionalized organopolysiloxane; CAB-O-SILO fumed silicas such as for example TG-709F, TG-308F, TG-810G, TG-811F, TG-822F, TG-824F, TG-826F, TG-828F or TG-829F with a surface area from 105 to 280 m2/g obtained from Cabot Corporation; and the like. Such conventional surface treated silicas are applied to the toner surface for toner flow, triboelectric charge enhancement, admix control, improved development and transfer stability, and higher toner blocking temperature.

In other embodiments, other surface treated silicas can also be used. For example, a silica surface treated with polydimethylsiloxane (PDMS), can also be used. Specific examples of suitable PDMS-surface treated silicas include, for example, but are not limited to, RY50, NY50, RY200, RY200S and R202, all available from Nippon Aerosil, and the like.

In embodiments, the silica additive is a surface-treated silica. When so provided, the surface treated silica may be the only surface treated silica present in the toner composition. As described below, the additive package may also beneficially include large-sized sol-gel silica particles as spacer particles, which is distinguished from the surface treated silica described herein. Alternatively, for example where small amounts of other surface treated silicas are introduced into the toner composition for other purposes, such as to assist toner particle classification and separation, the surface treated silica is the only xerographically active surface treated silica present in the toner composition. Any other incidentally present silica thus does not significantly affect any of the xerographic printing properties. In some embodiments, the surface treated silica is the only surface treated silica present in the additive package applied to the toner composition. Other suitable silica materials are described in, for example, U.S. Pat. No. 6,004,714, the entire disclosure of which is incorporated herein by reference.

In some embodiments, the silica additive may be present in an amount of from about 1 to about 4 percent by weight, based on a weight of the toner particles without the additive or, in an amount of from about 0.5 to about 5 parts by weight additive per 100 parts by weight toner particle or from about 1.6 weight percent to about 2.8 weight percent or from about 1.5 or from about 1.8 to about 2.8 or to about 3 percent by weight.

In some embodiments, the silica has an average particle size of from about 10 to about 60 nm, or from about 15 to about 55 nm, or from about 20 to about 50 nm.

Another component of an additive package may include a titania, and in embodiments a surface treated titania. In embodiments, the surface treated titania used in embodiments is a hydrophobic surface treated titania.

Conventional surface treated titania materials are known and include, for example, metal oxides such as TiO2, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; an isobutyltrimethoxysilane (i-BTMS) treated hydrophobic titania obtained from Titan Kogyo Kabushiki Kaisha (IK Inabata America Corporation, New York); and the like. Such surface treated titania are applied to the toner surface for improved relative humidity (RH) stability, triboelectric charge control and improved development and transfer stability.

While any of the conventional and available titania materials can be used, it may be beneficial that specific surface treated titania materials be used, which have been found to unexpectedly provide superior performance results in toner particles. Thus, while any of the surface treated titania may be used in the additive package, in some embodiments the material may be a "large" surface treated titania (i.e., one having an average particle size of from about 30 to about 50 nm, or from about 35 to about 45 nm, particularly about 40 nm). In particular, it has been found that the surface treated titania provides one or more of better cohesion stability of the toners after aging in the toner housing, and higher toner conductivity, which increases the ability of the system to dissipate charge patches on the toner surface.

Specific examples of suitable surface treated titanias include, for example, but are not limited to, an isobutyltrimethoxysilane (i-BTMS) treated hydrophobic titania obtained from Titan Kogyo Kabushiki Kaisha (IK Inabata America Corporation, New York); SMT5103, obtained from Tayca Corporation or Evonik Industries, comprised of a crystalline titanium dioxide core MT500B coated with DTMS (decyltrimethoxysilane); and the like. The decyltrimethoxysilane (DTMS) treated titania is particularly beneficial, in some embodiments.

In embodiments, only one titania, such as surface treated titania, is present in the toner composition. That is, in some embodiments, only one kind of surface treated titania is present, rather than a mixture of two or more different surface treated titanias.

The titania additive may be present in an amount of from about 0.5 to about 4 percent by weight, based on a weight of the toner particles without the additive, or about 0.5 to about 2.5, or about 0.5 to about 1.5, or about 2.5 or to about 3 percent by weight. In some embodiments, the surface-treated titania has an average particle size of from about 10 to about 60 nm, or from about 20 to about 50 nm, such as about 40 nm.

Another component of the additive package may include a spacer particle. In embodiments, the spacer particles have an average particle size of from about 100 to about 150 nm. In some embodiments, the spacer particles are selected from the group consisting of latex particles, polymer particles, and sol-gel silica particles. In some embodiments, the spacer particle used in embodiments is a sol-gel silica.

Spacer particles, particularly latex or polymer spacer particles, are described in, for example, U.S. Patent Application Publication No. 2004/0137352, the entire disclosure of which is incorporated herein by reference.

In some embodiments, the spacer particles are comprised of latex particles. Any suitable latex particles may be used without limitation. As examples, the latex particles may include rubber, acrylic, styrene acrylic, polyacrylic, fluoride, or polyester latexes. These latexes may be copolymers or crosslinked polymers. Specific examples include acrylic, styrene acrylic and fluoride latexes from Nippon Paint (e.g. FS-101, FS-102, FS-104, FS-201, FS-401, FS-451, FS-501, FS-701, MG-151 and MG-152) with particle diameters in the range from 45 to 550 nm, and glass transition temperatures in the range from 65° C. to 102° C.

The toner resin particles may be derived by any conventional method in the art. Suitable polymerization methods may include, for example, emulsion polymerization, suspension polymerization and dispersion polymerization, each of which is well known to those versed in the art. Depending on the preparation method, the latex particles may have a very narrow size distribution or a broad size distribution. In the latter case, the latex particles prepared may be classified so that the latex particles obtained have the appropriate size to act as spacers as discussed above. Commercially available latex particles from Nippon Paint have very narrow size distributions and do not require post-processing classification (although such is not prohibited if desired).

In a further embodiment, the spacer particles may also comprise polymer particles. Any type of polymer may be used to form the spacer particles of this embodiment. For example, the polymer may be polymethyl methacrylate (PMMA), e.g., 150 nm MP1451 or 300 nm MP116 from Soken Chemical Engineering Co., Ltd. with molecular weights between 500 and 1500 K and a glass transition temperature onset at 120° C., fluorinated PMMA, KYNAR® (polyvinylidene fluoride), e.g., 300 nm from Pennwalt, polytetrafluoroethylene (PTFE), e.g., 300 nm L2 from Daikin, or melamine, e.g., 300 nm EPOSTAR-S® from Nippon Shokubai.

In embodiments, the spacer particles on the surfaces of the toner particles are believed to function to reduce toner cohesion, stabilize the toner transfer efficiency and reduce/minimize development falloff characteristics associated with toner aging such as, for example, triboelectric charging characteristics and charge through. These additive particles function as spacers between the toner particles and carrier particles and hence reduce the impaction of smaller conventional toner external surface additives, such as the above-described silica and titania, during aging in the development housing. The spacers thus stabilize developers against disadvantageous burial of conventional smaller sized toner additives by the development housing during the imaging process in the development system. The spacer particles function as a spacer-type barrier, and therefore the smaller toner additives are shielded from contact forces that have a tendency to embed them in the surface of the toner particles. The spacer particles thus provide a barrier and reduce the burial of smaller sized toner external surface additives, thereby rendering a developer with improved flow stability and hence excellent development and transfer stability during copying/printing in xerographic imaging processes. The toner compositions of the present disclosure thereby exhibit an improved ability to maintain their DMA (developed mass per area on a photoreceptor), their TMA (transferred mass per area from a photoreceptor) and acceptable triboelectric charging characteristics and admix performance for an extended number of imaging cycles.

The spacer particles may be present in an amount of from about 0.3 to about 2.5 percent by weight, based on a weight of the toner particles without the additive, or from about 0.6 to about 1.8, or from about 0.5 to about 1.8 percent by weight.

In some embodiments, the spacer particles are large sized silica particles. Thus, in some embodiments, the spacer particles have an average particle size greater than an average particles size of the silica and titania materials, discussed above. For example, the spacer particles in this embodiment are sol-gel silicas. Examples of such sol-gel silicas include, for example, X24, a 120 nm sol-gel silica surface treated with hexamethyldisilazane, available from Shin-Etsu Chemical Co., Ltd. In some embodiments, the spacer particles may have an average particle size of from about 60 to about 300 nm, or from about 75 to about 205 nm, such as from about 100 nm to about 150 nm.

In some embodiments, toner particles disclosed herein may be formed in the presence of surfactants. For example, surfactants may be present in a range of from about 0.01 to about 20, or about 0.1 to about 15 weight percent of the reaction mixture. Suitable surfactants include, for example, nonionic surfactants such as dialkylphenoxypoly-(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX890™ and ANTAROX 897™. In some embodiments, an effective concentration of the nonionic surfactant may be in a range of from about 0.01 percent to about 10 percent by weight, or about 0.1 percent to about 5 percent by weight of the reaction mixture.

Suitable anionic surfactants may include, without limitation sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™, available from Kao, Dowfax 2A1 (hexa decyldiphenyloxide disulfonate) and the like, among others. For example, an effective concentration of the anionic surfactant generally employed is, for example, about 0.01 percent to about 10 percent by weight, or about 0.1 percent to about 5 percent by weight of the reaction mixture In some embodiments, anionic surfactants may be used in conjunction with bases to modulate the pH and hence ionize the aggregate particles thereby providing stability and preventing the aggregates from growing in size. Such bases can be selected from sodium hydroxide, potassium hydroxide, ammonium hydroxide, cesium hydroxide and the like, among others.

Examples of additional surfactants, which may be added optionally to the aggregate suspension prior to or during the coalescence to, for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. For example, an effective amount of the anionic or nonionic surfactant generally employed as an aggregate size stabilization agent is, for example, about 0.01 percent to about 10 percent or about 0.1 percent to about 5 percent, by weight of the reaction mixture.

In some embodiments acids that may be utilized in conjunction with surfactants to modulate pH. Acid may include, for example, nitric acid, sulfuric acid, hydrochloric acid, acetic acid, citric acid, trifluoroacetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

In some embodiments, the low melt toner particles disclosed herein may comprise a coagulant. In some embodiments, the coagulants used in the present process comprise polymetal halides, such as polyaluminum chloride (PAC) or polyaluminum sulfo silicate (PASS). For example, the coagulants provide a final toner having a metal content of, for example, about 400 to about 10,000 parts per million. In another feature, the coagulant comprises a poly aluminum chloride providing a final toner having an aluminum content of about 400 to about 10,000 parts per million.

EXAMPLES

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

Example 1

This Example describes the preparation of low melt toners in accordance with some embodiments. Table 1 below summarizes the data given in the following preparatory procedures.

Control Formulation: (Normal Pigment Loading, No Crystalline Polyester)

To a 20 gallon reactor charged with 37.947 kg of deionized water (DIW) was added 14.9 kg of EP07, a Polystyrene Butyl Acetate ($T_g$ of 51° C.), latex at 41% solids (approximately 6.1 kg of resin and 8.8 kg of water and 55% of the solid formulation) with 4.162 kg Regal 330 at 17% solids and 3.201 kg Q436B wax at 30% solids and 0.8 kg of Paraffin Wax at 30.5% solids. After reaching nominal particle size target for aggregation at 5.4 microns at 200 RPM added 7.586 kg EP07 latex at 41% solids to add the shell. Reaching particle size of 6.5 um at 160 RPM the particle was frozen by adding 1800 grams of 0.4 NaOH to reach a pH of 5.4 and a RPM of 135. Particle was coalesced at 96° C. for three hours at 135 RPM was reached until circularity target of approximated 0.971 was met. The reaction was then quenched at 35° C. in the heat exchanger over a period of 15 minutes and then adjust the particle to 8.8 pH with NaOH.

Hyperpigmented Control Formulation (Hyperpigmentation Loading, No Crystalline Polyester)

For the 20 gallon reactor we put in 39.562 kg of DIW with 13.001 kg of EP07 latex at 41% solids with 2.954 kg of NIPEX at 26% solids and 3.201 Q436B wax (0.96 kg of Q436B solid and 2.24 kg of water for a total solid percent in the toner at 8.8% solids) at 30% solids and 0.8 kg of Paraffin Wax at 30.5% solids. After reaching nominal particle size target for aggregation at 5.4 microns at 200 RPM added 7.586 kg EP07 latex at 41% solids to add the shell. Reaching particle size of 6.5 microns at 160 RPM the particle was frozen by adding 1800 grams of 0.4 NaOH to reach a pH of 5.4 and a RPM of 135. Particle was coalesced at 96° C. for three hours at 135 RPM was reached until circularity target of approximated 0.971 was met. Was then quenched at 35° C. in the heat exchanger over a period of 15 minutes and then adjust the particle to 8.8 pH with NaOH.

Formulation 1

For a 20 gallon reactor in 38.634 kg of DIW was added 10.837 kg of EP07 latex at 41% solids with 2.954 kg of C10C9 CPE at 30% solids with 4.026 kg NIPEX at 26% solids and 3.201 kg Q436B Wax at 30% solids and 0.8 kg of Paraffin Wax at 30.5% solids. After reaching nominal particle size target for aggregation at 5.4 microns at 200 RPM added 8.669 kg EP07 latex at 41% solids to add the shell. Reaching particle size of 6.5 microns at 160 RPM the particle was frozen by adding 1800 grams of 0.4 NaOH to reach a pH of 5.4 and a RPM of 135. The particles were coalesced at 96° C. for three hours at 135 RPM was reached until circularity target of approximated 0.971 was met. The reaction was quenched at 35° C. in a heat exchanger over a period of 15 minutes and then adjusted to 8.8 pH with NaOH.

Formulation 2

For a 20 gallon reactor in 38.634 kg of DIW was added 10.837 kg of EP07 latex at 41% solids with 2.954 kg of C1006 CPE at 30% solids with 4.026 kg NIPEX at 26% solids and 3.201 kg Q436B Wax at 30% solids and 0.8 kg of Paraffin Wax at 30.5% solids. After reaching nominal particle size target for aggregation at 5.4 microns at 200 RPM added 8.669 kg EP07 latex at 41% solids to add the shell. Reaching particle size of 6.5 microns at 160 RPM the particle was frozen by adding 1800 grams of 0.4 NaOH to reach a pH of 5.4 and a RPM of 135. Particle was coalesced at 96° C. for three hours at 135 RPM was reached until circularity target of approximated 0.971 was met. The reaction was then quenched at 35° C. in the heat exchanger over a period of 15 minutes and then adjust the particle to 8.8 pH with NaOH.

Figure 2:
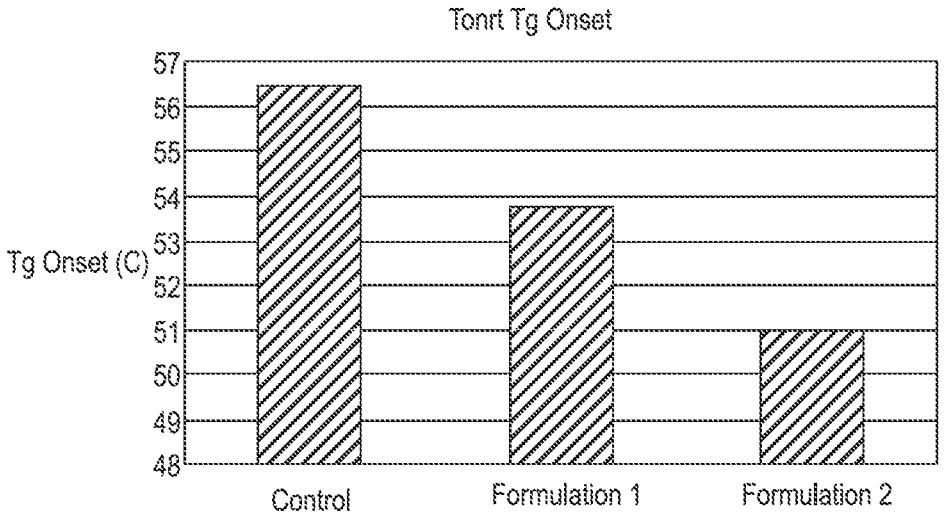
FIG. 2 shows a bar graph of toner $T_g$ onset for exemplary low melt toners in accordance with embodiments herein and comparison with a standard.
Figure 3:
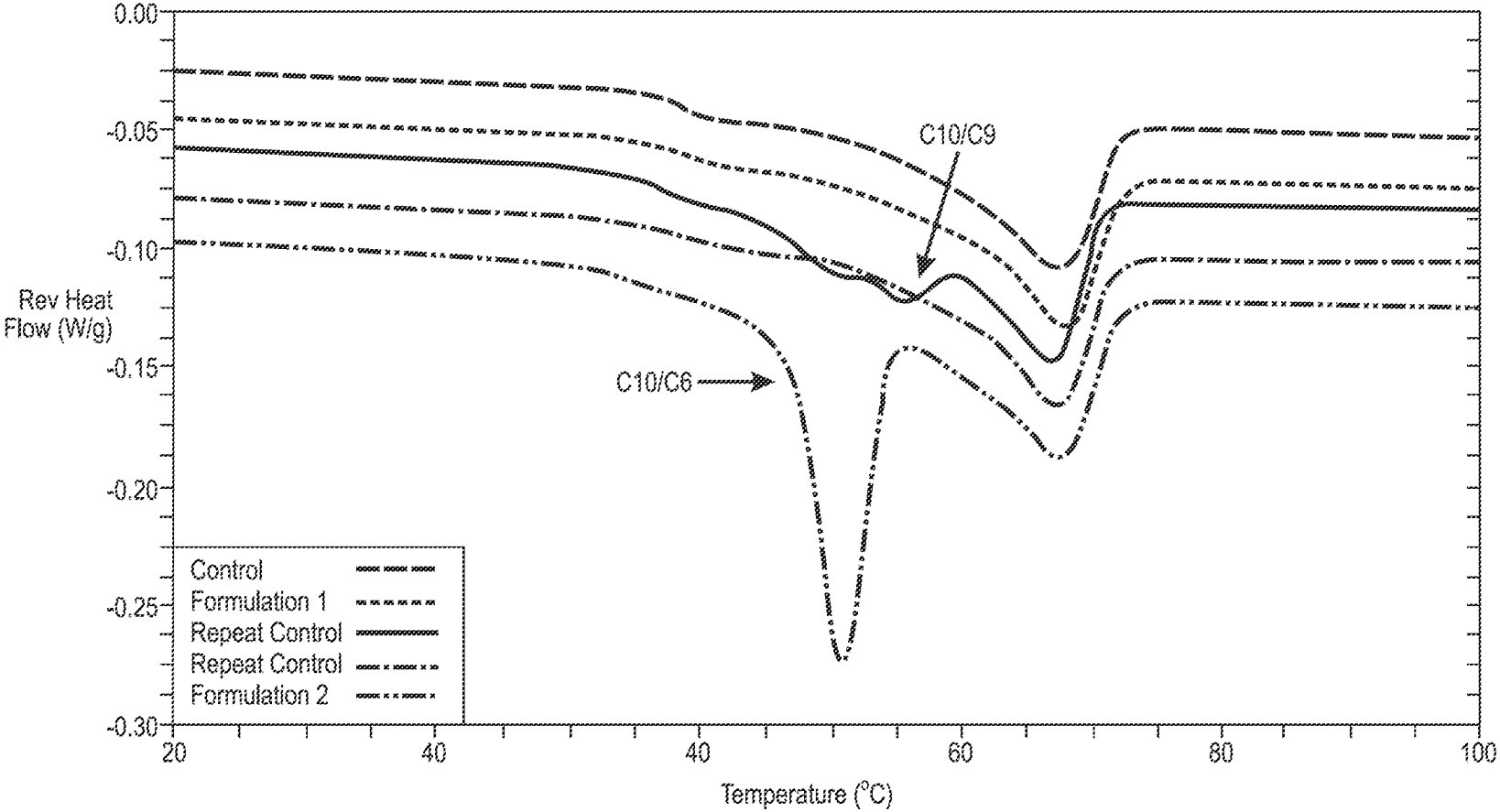
FIG. 3 shows a plot of results using differential scanning calorimetry (DSC) indicating enhanced melting and incorporation of different crystalline polyesters in accordance with embodiments herein.
Figure 4:
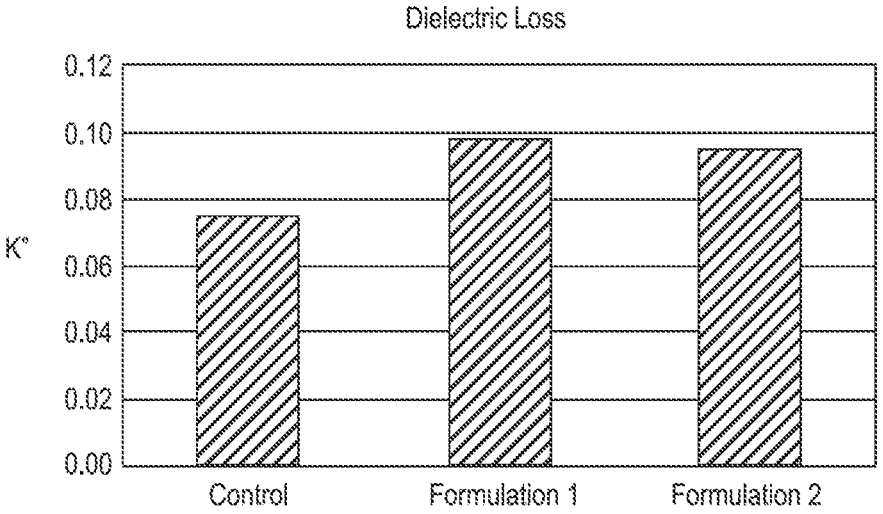
FIG. 4 shows a bar graph of dielectric loss for exemplary low melt toners in accordance with embodiments herein.

Formulation 1 and 2 toners offer superior thermal properties as indicated in FIGS. 1, 2 and 3, and should provide as a result a wider fusing latitude.

TABLE 1

| | Nominal Pigmented Control | | Nominal Hyperpigmented Control | | Formulation 1 | | Formulation 2 | |
|---|---|---|---|---|---|---|---|---|
| Component | Dry Weight Percent | Wet Batch Weight | Dry Weight Percent | Wet Batch Weight | Dry Weight Percent | Wet Batch Weight | Dry Weight Percent | Wet Batch Weight |
| Core Latex 1 | 55% EP07 | 14.9 kg | 48% EP07 | 13 kg | 41.2% EP07 | 10.84 kg | 41.2% EP07 | 10.84 kg |
| Core Latex 2 | — | — | — | — | 6.8% C10/C9 | 2.954 kg | 6.8% C10/C6 | 2.954 kg |
| Pigment | 6% Regal 330 | 4.162 kg | 9% NIPEX 35 | 4.026 kg | 9% NIPEX 35 | 4.026 kg | 9% NIPEX 35 | 4.026 kg |
| Wax 1 | 8.8% Q436B | 3.201 kg | 8.8% Q436B | 3.201 kg | 8.8% Q436B | 3.201 kg | 8.8% Q436B | 3.201 kg |
| Wax 2 | 2.2% Paraffin | 0.8 kg | 2.2% Paraffin | 0.8 kg | 2.2% Paraffin | 0.8 kg | 2.2% Paraffin | 0.8 kg |
| Shell Latex | 28% EP07 | 7.586 kg | 32% EP07 | 8.669 kg | 32% EP07 | 8.669 kg | 32% EP07 | 8.669 kg |

Figure 5:
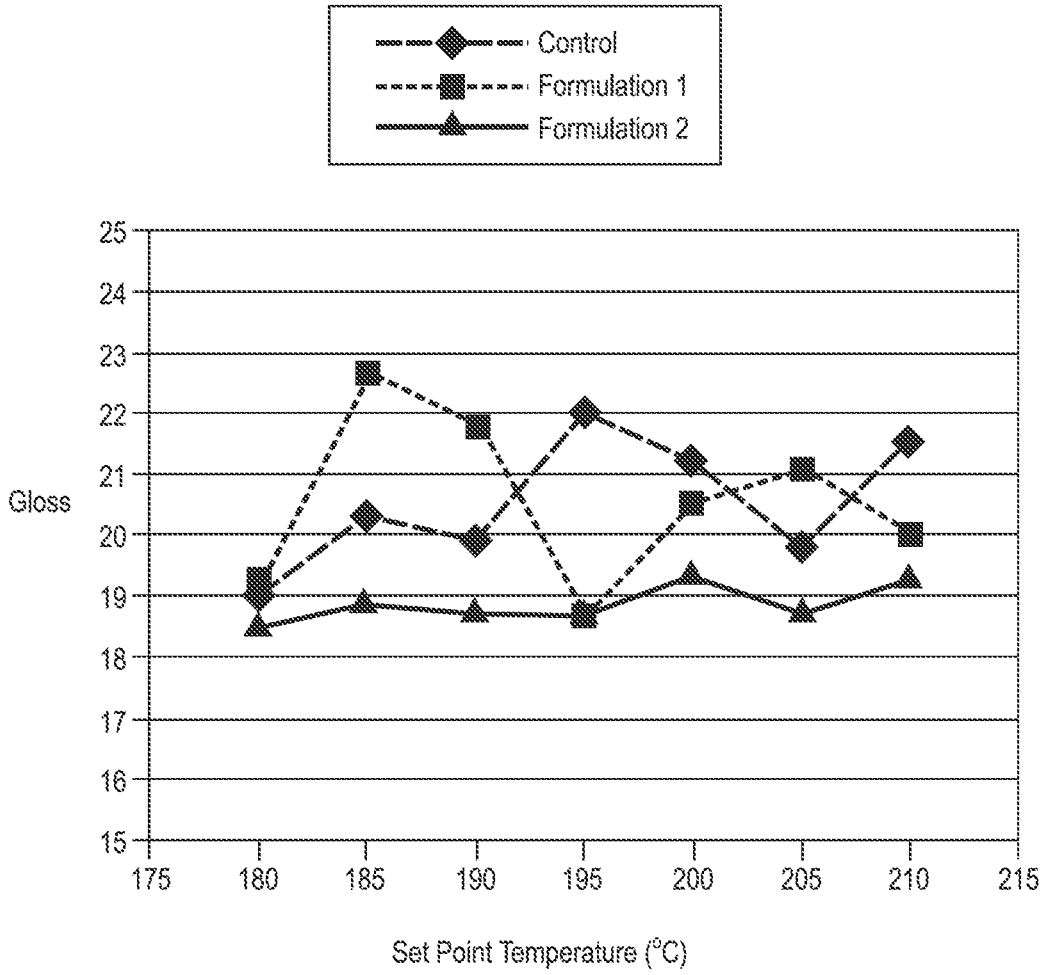
FIG. 5 shows a plot of gloss versus temperature for exemplary low melt toners in accordance with embodiments herein compared to a production control.
Figure 6:
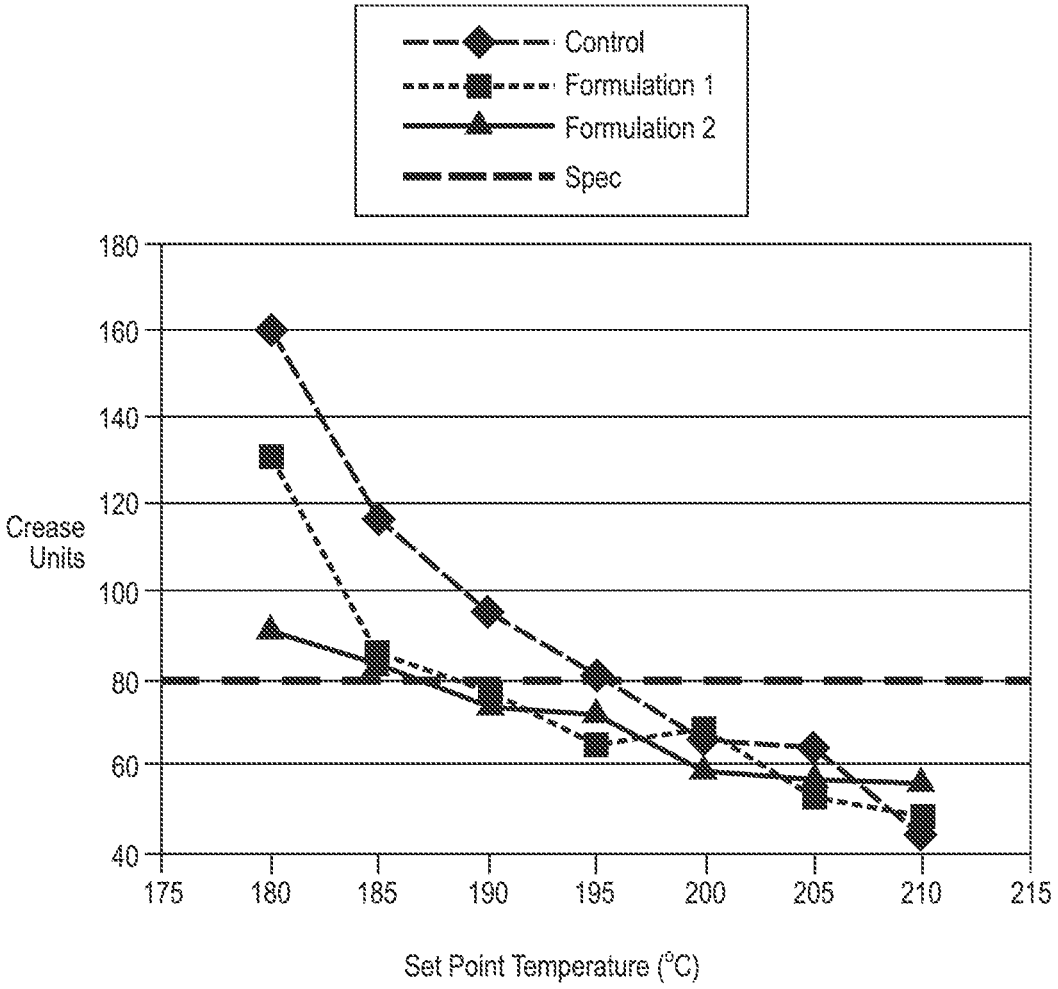
FIG. 6 shows a plot of crease versus set point temperature for exemplary low melt toners in accordance with embodiments herein compared to a production control.

FIG. 5 shows a plot of gloss versus temperature. The plot indicates that the gloss of Formulation 1 and Formulation 2 is equivalent to the nominal pigmented control (within 5 units is generally considered equivalent). FIG. 6 shows a plot of crease versus set point temperature. The observed increase in crease versus temperature for latitude is important for the ability to employ hyperpigmented toner in high speed machines and to improve fusing latitude. About a 10° C. increase in latitude compared to the nominal pigmented control is observed.

What is claimed is:

1. A low melt toner comprising:

a core comprising:

a core polystyrene-butyl acrylate resin;

a crystalline polyester resin;

a pigment present in an amount from about 7% to about 20% by weight of the low melt toner; and a paraffin wax;

wherein a weight ratio of the polystyrene-butyl acrylate resin to crystalline polyester resin is in a range from about 5:1 to about 7:1; and a shell disposed over the core comprising a shell polystyrene-butyl acrylate resin, wherein the shell polystyrene-butyl acrylate is present in a range from 25% to about 35% by weight of the low melt toner.

2. The low melt toner of claim 1, wherein the core polystyrene-butyl acrylate resin is present in an amount from about 30% to about 50% by weight of the low melt toner.

3. The low melt toner of claim 1, wherein the crystalline polyester resin is present in an amount from about 5% to about 10% by weight of the low melt toner.

4. The low melt toner of claim 1, wherein the paraffin wax is present in a range from about 1% to about 10% by weight of the low melt toner.

5. The low melt toner of claim 1, further comprising a second wax different from the paraffin wax.

6. The low melt toner of claim 5, wherein the second wax is a Fischer-Tropsch wax.

7. The low melt toner of claim 6, wherein the Fischer-Tropsch wax is present in a range from about 5% to about 8% by weight of the low melt toner.

8. A low melt toner comprising:

a core comprising:

a core polystyrene-butyl acrylate resin;

a crystalline polyester resin;

a pigment present in an amount from about 7% to about 20% by weight of the low melt toner; and a paraffin wax;

wherein the core polystyrene-butyl acrylate and the shell polystyrene-butyl acrylate are the same, and further wherein a weight ratio of the polystyrene-butyl acrylate resin to crystalline polyester resin is in a range from about 5:1 to about 7:1; and a shell disposed over the core comprising a shell polystyrene-butyl acrylate resin, wherein the shell polystyrene-butyl acrylate is present in a range from about 25% to about 35% by weight of the low melt toner.

9. The low melt toner of claim 1, wherein the pigment is present in a range from about 8% to about 10% by weight of the low melt toner.

10. The low melt toner of claim 1, wherein the pigment is carbon black.

11. A low melt toner comprising:

a core comprising:

a core polystyrene-butyl acrylate resin present in an amount in a range from about 35% to about 45% by weight of the low melt toner;

a crystalline polyester resin present in an amount in a range from about 5% to about 8% by weight of the low melt toner;

a pigment present in an amount in a range from about 7% to about 20% by weight of the low melt toner;

a Fischer-Tropsch wax present in an amount in a range from about 8% to about 10% by weight of the low melt toner; and a paraffin wax present in an amount in a range from about 1% to about 3% by weight of the low melt toner; and a shell disposed over the core comprising a shell polystyrene-butyl acrylate resin, wherein the shell polystyrene-butyl acrylate resin is present in an amount in a range from about 30% to about 35% by weight of the low melt toner.

12. The low melt toner of claim 11, wherein the pigment is present in an amount in a range from about 8% to about 10% by weight of the low melt toner.

13. The low melt toner of claim 11, wherein the low melt toner has a $T_g$ onset less than about 54° C.

14. The low melt toner of claim 11, wherein the shell further comprises a wax.

* * * * *